US008857134B2

(12) United States Patent
Lucas et al.

(10) Patent No.: US 8,857,134 B2
(45) Date of Patent: Oct. 14, 2014

(54) MULTI-HANDLED SEALED BAG

(75) Inventors: Nancy Lucas, Eagan, MN (US); Annette Martin, Burdett, NY (US); Mick Berning, Alva, OK (US); Arlis Sayler, Romeo, MI (US)

(73) Assignee: Cargill, Incorporated, Wayzala, MN (US)

( * ) Notice: Subject to any disclaimer, the term of this patent is extended or adjusted under 35 U.S.C. 154(b) by 0 days.

(21) Appl. No.: 13/345,964

(22) Filed: Jan. 9, 2012

(65) Prior Publication Data

US 2012/0102889 A1 May 3, 2012

Related U.S. Application Data

(62) Division of application No. 10/657,065, filed on Sep. 9, 2003, now Pat. No. 8,104,959.

(51) Int. Cl.

| | |
|---|---|
| ***B65B 43/26*** | (2006.01) |
| ***B65B 61/16*** | (2006.01) |
| ***B65D 75/56*** | (2006.01) |

(52) U.S. Cl.

CPC ..... *B65D 75/566* (2013.01); *B65B 61/16* (2013.01)

USPC ..... 53/467; 53/284; 53/284.7; 53/413; 53/477

(58) Field of Classification Search

USPC ..... 53/413, 467, 469, 477, 134.1, 284, 53/284.7

See application file for complete search history.

(56) References Cited

U.S. PATENT DOCUMENTS

| | | | | |
|---|---|---|---|---|
| 43,567 | A | | 7/1864 | Campbell |
| 1,897,910 | A | | 2/1933 | Malvern et al. |
| 2,067,367 | A | * | 1/1937 | Willetts et al. ..... 383/10 |
| 2,103,389 | A | | 12/1937 | Salfisberg |
| D173,328 | S | | 10/1954 | Stoll |
| 3,249,285 | A | | 5/1966 | Dollheimer et al. |
| 3,300,120 | A | | 1/1967 | McColgan |
| 3,339,825 | A | * | 9/1967 | Grevich ..... 383/9 |
| 3,383,017 | A | | 5/1968 | Krings |
| D213,479 | S | | 3/1969 | Williams |

(Continued)

FOREIGN PATENT DOCUMENTS

| | | |
|---|---|---|
| DE | 76 19 583 U1 | 10/1976 |
| DE | 3925856 A1 | 2/1991 |

(Continued)

OTHER PUBLICATIONS

International Search Report dated Nov. 11, 2004.

*Primary Examiner* — Hemant M Desai

(57) ABSTRACT

A sealed multi-handled bag is provided that includes a first handle at a first end and a second handle at a second end. In one embodiment, the handles are on substantially opposite ends of the bag. The sealed bag may be made from plastic and may contain loose materials, such as a salt. In some embodiments, one or more of the handles are formed from heat-sealed layers of bag material having a grip cut therein. A method for filling and sealing the multi-handled sealed bag includes filling a bag having a first closed end through a second open end, and sealing the second open end to form a handle. In one embodiment, sealing the second open end includes heat-sealing opposing layers of bag material together and cutting a handle through the layers. In another embodiment, the method includes folding-over the layers of bag material.

6 Claims, 9 Drawing Sheets

(56) References Cited

U.S. PATENT DOCUMENTS

| | | | | | |
|---|---|---|---|---|---|
| 3,615,711 | A | | 10/1971 | Markus et al. | |
| 3,693,867 | A | * | 9/1972 | Schwarzkopf | 383/27 |
| 3,782,622 | A | * | 1/1974 | Montgomery | 383/10 |
| 3,811,543 | A | | 5/1974 | Parrochia | |
| 3,858,789 | A | * | 1/1975 | Verbeke | 383/7 |
| D235,739 | S | * | 7/1975 | Christensen | D9/704 |
| 3,999,656 | A | | 12/1976 | Hydorn | |
| 4,084,689 | A | * | 4/1978 | Yamagata | 206/280 |
| 4,343,053 | A | | 8/1982 | O'Connor | |
| 4,483,445 | A | * | 11/1984 | Lepisto et al. | 383/203 |
| 4,576,316 | A | | 3/1986 | Foster | |
| 4,610,029 | A | | 9/1986 | Huhtala et al. | |
| 4,779,996 | A | | 10/1988 | Sengewald | |
| 4,911,562 | A | | 3/1990 | Mazzeschi | |
| 4,971,453 | A | | 11/1990 | Rantanen | |
| 4,988,213 | A | | 1/1991 | Mattle | |
| 5,083,413 | A | * | 1/1992 | Bennett | 53/413 |
| D327,217 | S | * | 6/1992 | Wallace | D9/707 |
| 5,338,117 | A | * | 8/1994 | Kucksdorf et al. | 383/9 |
| 5,393,293 | A | | 2/1995 | Cilia et al. | |
| D365,981 | S | | 1/1996 | Sullivan | |
| 5,558,438 | A | | 9/1996 | Warr | |
| 5,584,599 | A | | 12/1996 | Knittel | |
| 5,593,229 | A | | 1/1997 | Warr | |
| 5,611,626 | A | | 3/1997 | Warr | |
| 5,695,286 | A | | 12/1997 | Williamson et al. | |
| 5,782,562 | A | * | 7/1998 | Anspacher | 383/15 |
| 6,149,555 | A | * | 11/2000 | Kinback | 482/93 |
| 6,340,088 | B1 | | 1/2002 | Mouri et al. | |
| 6,402,379 | B1 | | 6/2002 | Albright | |
| 6,428,208 | B1 | * | 8/2002 | Addison et al. | 383/23 |
| 6,481,183 | B1 | * | 11/2002 | Schmidt | 53/412 |
| 6,609,999 | B2 | | 8/2003 | Albright | |
| 6,817,160 | B2 | * | 11/2004 | Schmidt | 53/412 |
| 6,886,980 | B1 | | 5/2005 | Diplock | |
| 6,923,574 | B2 | | 8/2005 | Siegel | |
| 7,716,901 | B2 | * | 5/2010 | Price | 53/413 |
| 8,342,587 | B2 | * | 1/2013 | Johnson et al. | 294/152 |
| 2002/0102032 | A1 | | 8/2002 | Sturgis et al. | |
| 2003/0041564 | A1 | * | 3/2003 | Schmidt | 53/412 |
| 2003/0235348 | A1 | | 12/2003 | Pape | |
| 2004/0112784 | A1 | * | 6/2004 | Colas et al. | 206/524.1 |
| 2005/0276521 | A1 | * | 12/2005 | Price | 383/10 |
| 2009/0170681 | A1 | * | 7/2009 | Kohn et al. | 493/223 |
| 2010/0142859 | A1 | * | 6/2010 | Cushman | 383/10 |
| 2012/0008878 | A1 | * | 1/2012 | Saville et al. | 383/16 |
| 2012/0106871 | A1 | * | 5/2012 | Goodman | 383/4 |

FOREIGN PATENT DOCUMENTS

| | | | | | |
|---|---|---|---|---|---|
| GB | 2 069 456 | A | | 8/1981 | |
| GB | 2 227 928 | A | | 8/1990 | |
| GB | 2 341 382 | A | | 3/2000 | |
| JP | 64-23955 | | | 1/1989 | |
| JP | 226460 | | | 7/1991 | |
| JP | 3-242156 | A | | 10/1991 | |
| JP | 07309353 | A | * | 11/1995 | B65D 33/12 |
| JP | 09323737 | A | * | 12/1997 | B65D 33/08 |

* cited by examiner

MULTI-HANDLED SEALED BAG

CROSS-REFERENCE TO RELATED APPLICATIONS

The present application is a divisional of U.S. patent application Ser. No. 10/657,065, filed Sep. 9, 2003, now U.S. Pat. No. 8,104,959, issued on Jan. 31, 2012 entitled MULTI-HANDLED SEALED BAG, which is hereby incorporated by reference in its entirety.

TECHNICAL FIELD

This invention relates generally to a multi-handled sealed bag. More particularly, the invention concerns a sealed loose-materials bag, such as a salt bag, having two or more handles and a method for filling and sealing such a bag.

BACKGROUND

There are many different types of sealed bags used for various purposes. One type includes moderate to heavy-duty sealed bags used for packaging loose materials. Conventional bags of this type frequently have a capacity of around 10 pounds to 100 pounds or more. For instance, conventional heavy-duty sealed bags are often used to package chemicals such as salt or fertilizer, landscaping materials such as gravel or potting soil, pet food, and the like. When filled with loose materials, these conventional bags may be difficult to carry without handles due to the pliancy of the bag and the ability for the loose materials to shift. For example, when a user grabs such a bag along its body, the loose materials contained therein may shift and thereby lessen the user's grip.

Many conventional sealed bags that package loose materials include a handle on one end to improve a user's ability to grab the bag. For moderate to heavy-duty bags, however, a single handle may be less desirable. For example, conventional paper or plastic heavy-duty bags have a single handle formed from the bag material. These handles may stretch during use with heavier loads. Further, it may be difficult and uncomfortable for a user to carry these heavy bags using a single handle. Accordingly, a need exists for a moderate to heavy-duty loose-materials bag having improved features for handling and carrying the bag.

SUMMARY

In order to overcome the above-described disadvantages and other disadvantages that will become apparent when reading this specification, aspects of the present invention provide a multi-handled sealed bag. According to one aspect of the invention, the multi-handled sealed bag may have a first handle on a substantially opposite end from a second handle. According to another aspect, the sealed bag may be made from plastic and contain loose materials, such as a salt. One or more of the handles may be formed from heat-sealed layers of bag material having a handle cut therein according to a further aspect of the invention.

Aspects of the present invention further provide a method for filling and sealing a multi-handled sealed bag that includes filling a bag having a closed end through an open end, and sealing the open end to form a handle. Sealing the open end may include heat-sealing opposing layers of bag material together and cutting a handle through the layers. Sealing the open end may also include sealing opposing layers of bag material together near a pre-cut handle. The method may include folding-over the layers of bag material to form a handle flap. Other aspects of the invention provide a method for filling and sealing a multi-handled sealed bag that includes sealing a first end to form a flap and a handle in the flap, filling the bag through an opposite second end, sealing the second end, and attaching a rigid handle to the second end. Other features and advantages of various aspects of the invention will become apparent with reference to the following detailed description and figures.

BRIEF DESCRIPTION OF THE DRAWINGS

The invention will be described in detail in the following description of preferred embodiments with reference to the following figures wherein.

DETAILED DESCRIPTION OF THE FIGURES

Figure 1:
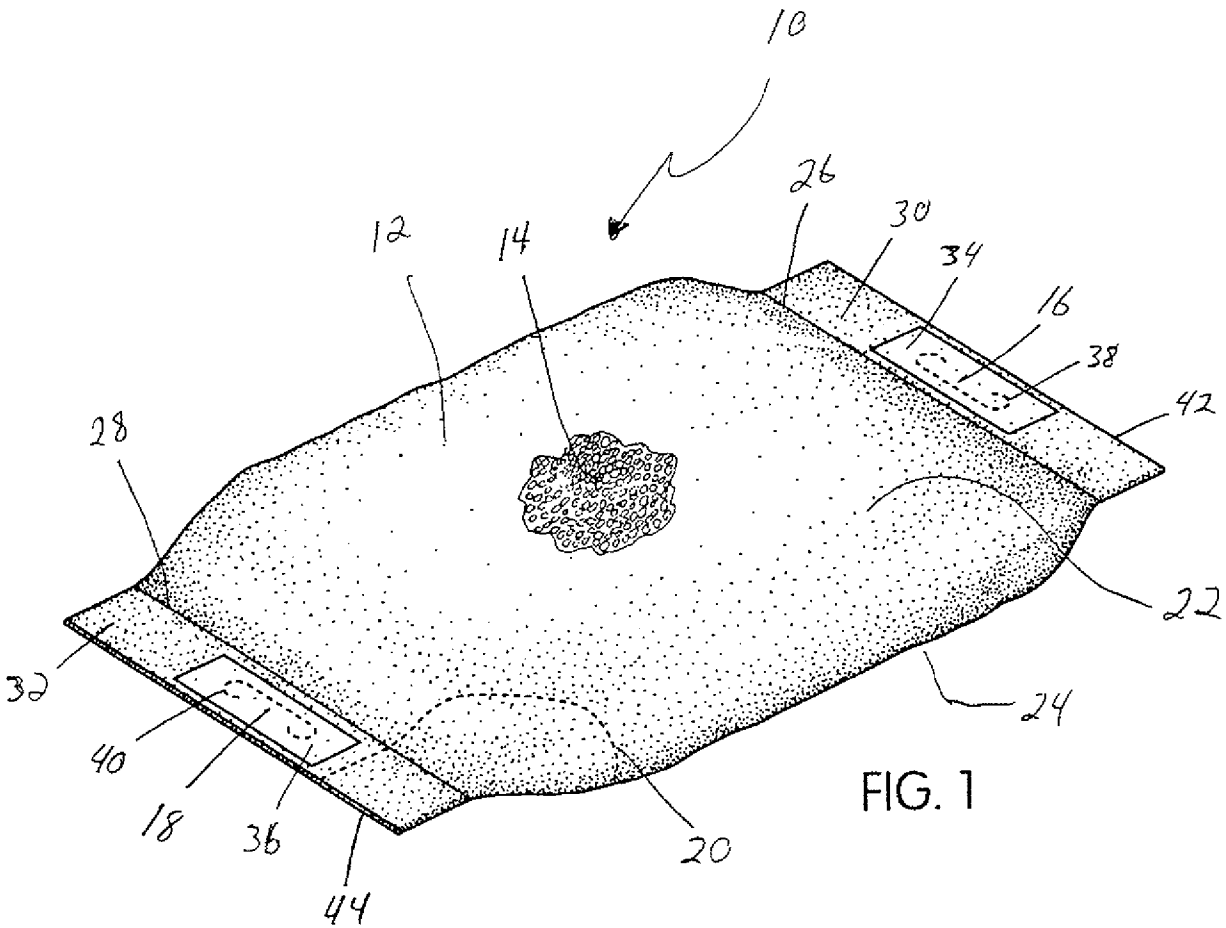
FIG. 1 is a perspective view of a two-handled loose-material bag according an embodiment of the invention.
Figure 2:
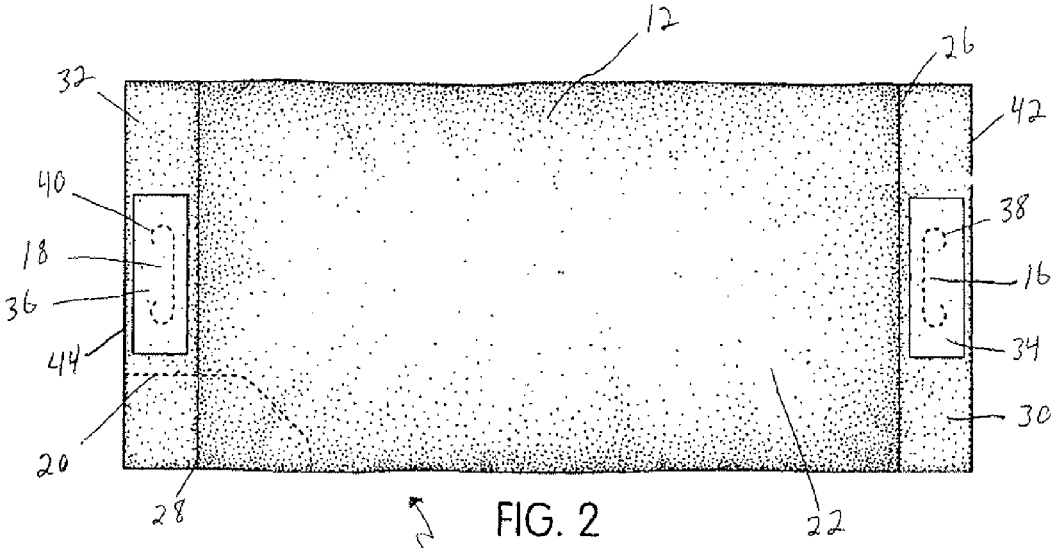
FIG. 2 is a top view of the bag of FIG. 1.
Figure 3:
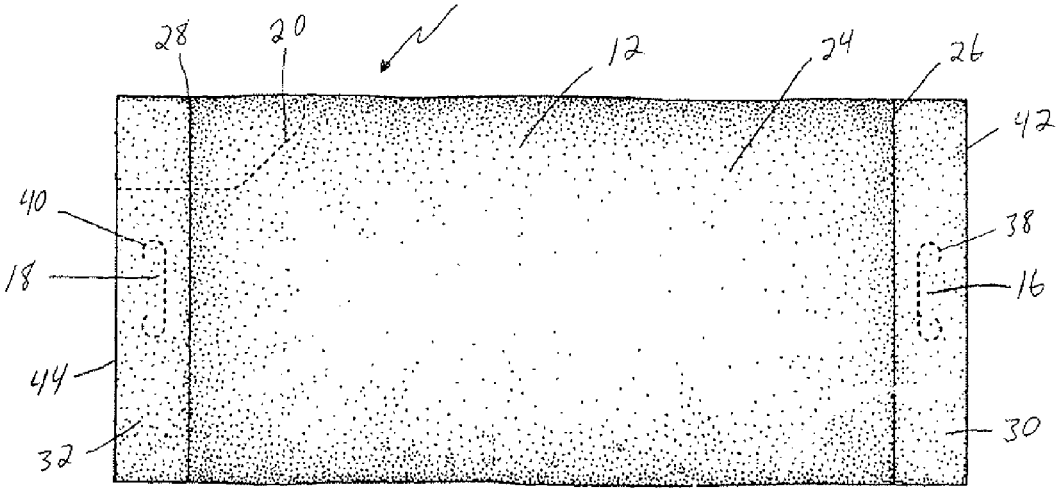
FIG. 3 is a bottom view of the bag of FIG. 1.
Figure 4:
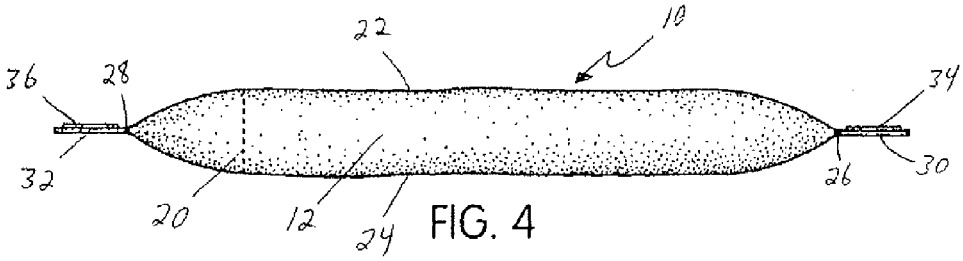
FIG. 4 is a side view of the bag of FIG. 1.

The various aspects of the invention may be embodied in various forms. The following description of the figures shows by way of illustration various embodiments in which aspects of the invention may be practiced. It is to be understood that other embodiments may be utilized and structural and functional modifications may be made without departing from the scope of the present invention. Referring now to FIGS. 1-4, a two-handled loose-material bag 10 according to an embodiment of the invention is shown. As shown, bag 10 generally includes a body 12, loose-material 14 stored within body 12, a first handle 16 at a first end, a second handle 18 at a second end generally opposite to the first end, and a tear seam 20 formed in body 12.

Bag 10 may be made from a variety of materials, such as sheets 22 and 24 of single-ply or multi-ply plastic. For example, sheets 22, 24 may be single-ply polyolefin plastic sheets such as polyethylene or polypropylene. The plastic sheets may have a thickness of about 3 to 12 mils. Preferably, sheets 22, 24 have a thickness of about 5 to 10 mils, and even more preferably about 5.5 mils. Plastic sheets in these ranges provide sufficient strength for heavy-duty packages, such as packages containing about 10 to 100 pounds of loose materials; although, plastic sheets in other ranges may be appropriate. Other sheet materials may include woven and non-woven fabric, paper materials, sheets formed from plastic and/or glass fibers, etc. Combinations of sheet materials are also appropriate, such as paper sheets lined with plastic. Body 12 is preferably formed from a tube of plastic material formed from sheets 22 and 24 connected along their lateral sides, which are sealed at opposite ends. It may also be formed via other methods, such as by connecting opposing plastic sheets 22 and 24 on 4 sides.

Bag 10 is preferably made from plastic, which permits storage of moisture-sensitive materials. For instance, it may be desirable to package salt, fertilizer, cement, granular chemicals, pet food, landscaping materials such as mulch, and similar moisture-sensitive loose-materials in sealed plastic bag 10. The term loose-materials as used herein generally refers to free flowing materials, such as liquids or granular materials that can be moist or dry. These bags may have a capacity to hold around 10 pounds to 100 pounds of loose-materials, and preferably around 25 pounds to 60 pounds. As such, bag 10 may be used for moderate to heavy-duty applications.

Moderate to heavy-duty bags filled with loose-materials may be difficult to carry without a handle or with only a single handle. Because the loose-materials 14 stored therein are generally free flowing, when a user grabs bag 10 about its body 12, the bag conforms to the user's grip. Depending on how freely loose-materials 14 flow and how easily bag 10 conforms to the user's grip, it may be difficult for the user to grip body 12. Further, the user's grip may change as loose-materials 14 continue to flow while bag 10 is being carried, which may degrade his or her grip.

Carrying hag 10 using a single handle 16 or 18 may be desirable in certain circumstances, such as for lightweight applications. However, in many circumstances, such as when carrying heavier bags, using a single handle 16 or 18 may be less desirable. For example, the single handle may stretch. Further, the concentration of force using a single handle may be uncomfortable for the user. For instance, suppose a 100-pound bag formed from opposing layers of 5.5 mil thick plastic has a handle cut through sealed layers of the plastic. As such, the plastic in the handle region may be 11 mils thick, or 0.011 of an inch. Suppose the handle is three inches long. Without bunching, such a handle transmits over 3000 p.s.i. of pressure to the user's hand. With reasonable bunching when carrying the bag, the effective thickness of the handle may be about one-eight inch wide. As such, the handle transmits about 267 p.s.i. of pressure to the user's hand.

Providing a pair of handles at opposite ends of bag 10 greatly reduces the pressure applied to a user's hands. Simply using two handles reduces the applied pressure in half, for example, to 133 p.s.i. using the example above. When carrying bag 10 using handles at opposing ends that are cut out of plastic material, such as handles according to the present embodiment, the pressure may be reduced further. This is due to the increased width of material at the cutout handle that is applied to the user's hands when the bag is substantially horizontal. When the bag is horizontally oriented, the user's hand contacts side portions of the handle as well as the cutout portion. Using the example above, the width of handle material applied to the user's hands may be about one-half an inch while carrying bag 10 in a substantially horizontal orientation. As such, the pressure applied to each hand when carrying a 100-pound bag is about 33 p.s.i.—a reduction of 234 p.s.i. compared to a bag having a single handle cut out of plastic sheet material.

Further, providing a pair of handles at opposing ends of bag 10 improves the user's ability to control moderate to heavy-duty bags. This is particularly true when loose-materials are packaged that can shift or flow when bag 10 is carried. By positioning handles 16, 18 at opposite ends, a user has two points of contact with bag 10, which provides a larger degree of control over bag 10 compared to a single handle.

This may be particularly advantageous for salt bags, such as bags containing water conditioner salt, de-icing salt, and agricultural salt. For these bags, the user may need to maintain increased control of bag 10 as the salt is poured from the bag. For instance, a user of bag 10 containing de-icing salt will be able to better control the pour rate and spreading of de-icing salt over a driveway or sidewalk using the pair of handles 16 and 18 disposed at opposite ends. By controlling opposing ends of bag 10, the user can more easily control the orientation of bag 10 and thereby the flow rate of salt there from.

In another example, a salt bag having handles at opposite ends provides users with more flexibility in dispensing the salt. For example, a tall first user may lift bag 10 using handle 16 opposite tear seam 20 to empty the contents (e.g., water-softener salt) into a desired container (e.g., water-softener unit) from the bottom of bag 10. A shorter second user may lift bag 10 using handle 18 near tear seam 20 to pour the contents into a desired container from the top of bag 10.

In other variations, a plurality of handles may be placed at different positions along the exterior of the bag, which can provide the user with a variety of choices for carrying and handling bag 10. For example, placing a handle along each of the four edges of bag 10 could allow the user to choose which pair of handles to use. Further, using two handles reduces the stress on a user's hands compared with a single handle.

Handles 16 and 18 may be formed by sealing opposing sheets 22 and 24 such that a length of material extends beyond seals 26 and 28 to form flaps 30 and 32. The width of flaps 30 and 32 may be about 2 to 4 inches wide, and is preferably about 2.5 to 3.5 inches wide. Depending on the material used for sheets 22 and 24, sheets 22 and 24 may be sealed via an adhesive bond, a heat seal, a sewn seam, etc. When using plastic material for sheets 22 and 24, the sheets are preferably sealed via a heat seal, which may be formed using a hot press, an ultrasonic heat-sealing process, a hot air sealing process, a hot band heating process or similar methods.

Preferably, a second distal seal 42 and 44 may be formed at the distal ends of flaps 30 and 32 to improve the connection between sheets 22 and 24 in flaps 30 and 32. Improving the connection between sheets 22 and 24 in the flap regions keeps the sheets from separating at the distal ends of the flaps. This provides improved handles 16, 18 formed in the flaps by ensuring a user engages both sheets 22 and 24 when grabbing either one of handle 16 and 18.

Seals 26 and 28 are preferably substantially permanent, non-resealable bonds. Using plastic or a similar substantially moisture-impervious material for sheets 22 and 24, combined with using substantially permanent bonds for seals 26 and 28, provides a large degree of protection to the loose materials 14 stored within bag 10. Substantially permanent bonds 26 and 28, such as formed via a heat sealing process, are highly impervious to air and moisture, which protects loose materials 14 from such contact. Further, substantially permanent bonds 26 and 28 provide a robust seal that is difficult to inadvertently break, such as during shipping and handling. Thus, seals 26 and 28 are preferably a substantially permanent bond, such as a heat seal bond or a permanent adhesive bond that provides a substantially impermeable attachment between sheets 22 and 24.

In order to reinforce the handles, a patch 34, 36 may optionally be placed on one or both sides of flaps 30 and 32. Patches 34, 36 may include a plastic material about 2 to 12 mils thick, and preferably about 5.5 mils thick. Patches 34 and 26 may be made from a plastic strips, such as polyethylene, which are bonded respectively to flaps 30 and 32. Patches 34 and 36 may be made from other materials, such as fibrous tape known as DUCT tape or TYVEK. Patches 34 and 36 may be adhered using various means, such as a heat bond, an adhesive, or a resin such as an epoxy or a hydrocarbon resin.

To form each handle 16 and 18, a series of perforations may be cut through the layers of material 30, 32 and patch 34, 36 to form a grip 38, 40. Alternatively, the grip 38 and 40 may be formed from a single cut. One or both of grips 38 and 40 may be cut through flaps 30 and 32 after the flaps are formed and bag 10 is filled and sealed. Alternatively, grips 38 and 40 may be pre-cut in panels 22 and 24 prior to forming bag 10. Further, one or both of grips 38 and 40 may be pre-cut in unfilled bag 10. A cutout handle provides a simple and inexpensive handle that works well with a bag having handles at opposing ends. This is because the vertical angle of the bag affects the width of material transmitting force to the user's hand. When using handles at opposite ends, bag 10 is generally oriented in a horizontal position, which greatly improves the amount of handle material transmitting force to the user's hand.

As shown in FIGS. 1-4, tear seam 20 may be formed from a line of perforations through sheets 22 and 24 and material 32 as disclosed in U.S. Pat. No. 6,402,379. The perforations may be punched or cut through sheets 22 and 24. The perforations may be formed prior to forming bag 10 as part of the process of forming bag 10, or after bag 10 is formed. Other breakout technologies may also be used, such as various other tear seam designs, tear-off end portions, pull-apart end seams, etc.

Figure 5:
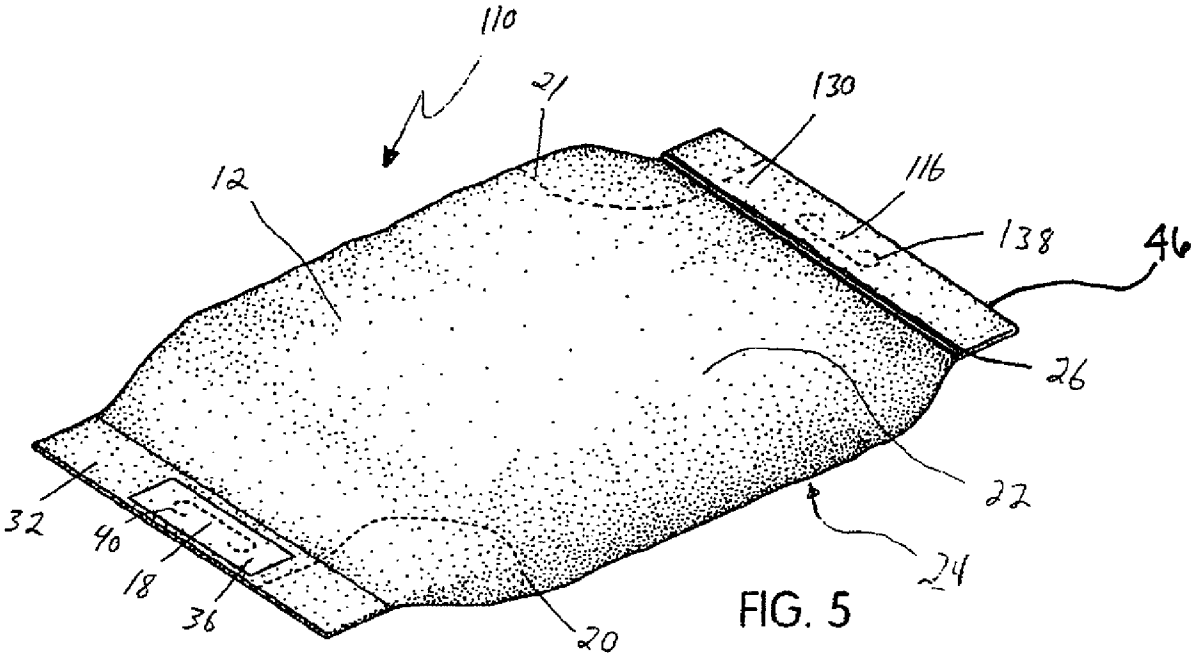
FIG. 5 is a perspective view of a two-handled loose-material bag according to another embodiment of the invention.
Figure 6:
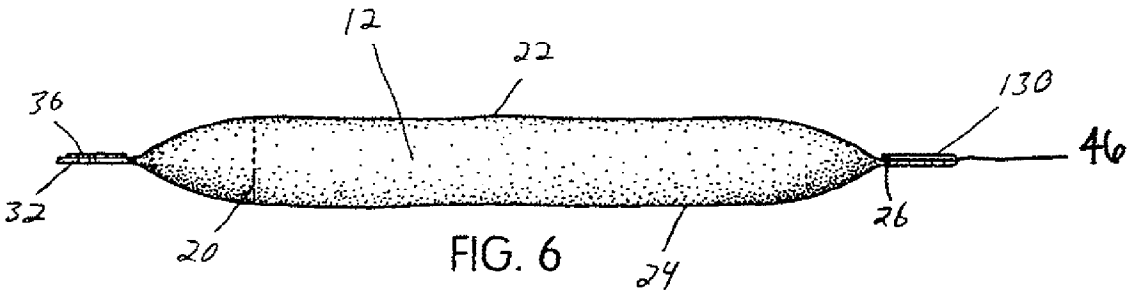
FIG. 6 is a side view of the bag of FIG. 5.

Referring now to FIGS. 5 and 6, a two-handled loose-material bag 110 according to another embodiment of the invention is shown. Bag 110 generally includes the aspects and preferences of bag 10, except as pertaining to the fold-over flap 130 discussed hereafter and the second tear seam 21. As shown, bag 110 includes a first flap 32 formed as discussed in relation to bag 10. The second flap 130 is formed by folding over end portions of sheets 22 and 24. The fold-over portions are joined along seal 26 in the same manner discussed in relation to bag 10. A grip 138 is cut through the double layers of material in flap 130 to form handle 116. As with bag 10, grip 138 may be formed from a complete cutout or a series of perforations. Further, as with bag 10, grip 138 may be cut after bag 110 is filled and sealed, or pre-cut prior to filling and sealing bag 110.

By doubling the layers of material in flap 130, a reinforced handled 116 is provided. For example, if each sheet 22, 24 has a thickness of about 5.5 mils, then flap 130 has an overall thickness of about 22 mils compared to 11 mils without the foldover. The thicker handle improves strength and reduces the amount of pressure applied to a user's hand. Bag 110 further includes a second tear seam 21 disposed proximate to handle flap 130. Handles at opposite ends along with tear seams at opposite ends provide a user with flexibility in how to handle bag 110 and dispense materials therefrom.

Figure 7:
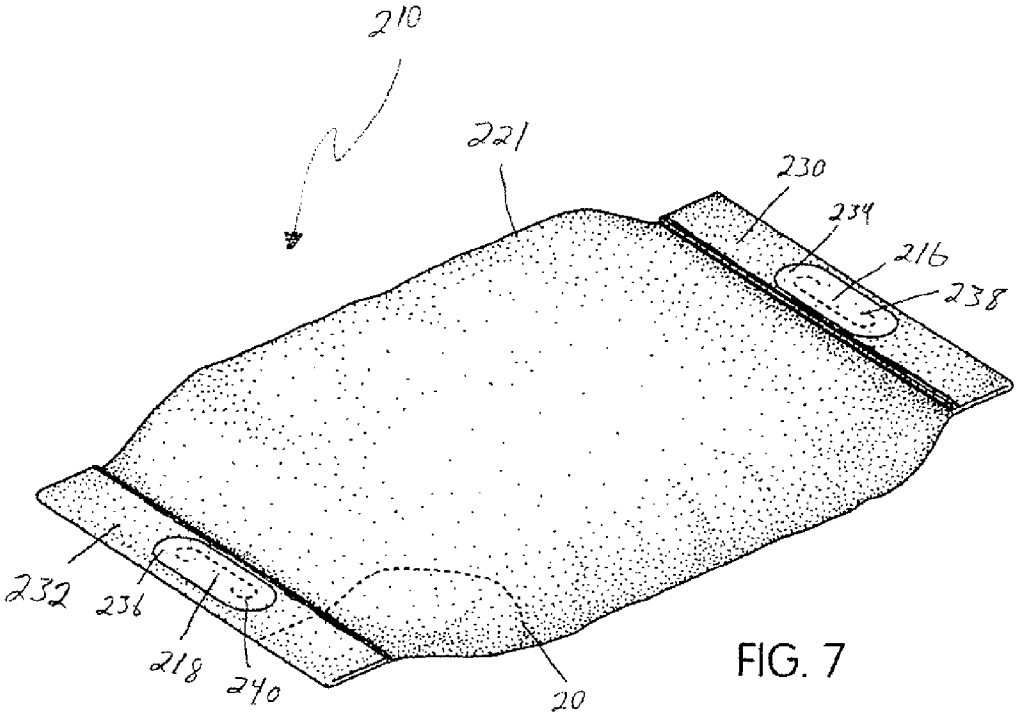
FIG. 7 is perspective view of a two-handled loose-material bag according to a further embodiment of the invention.
Figure 8:
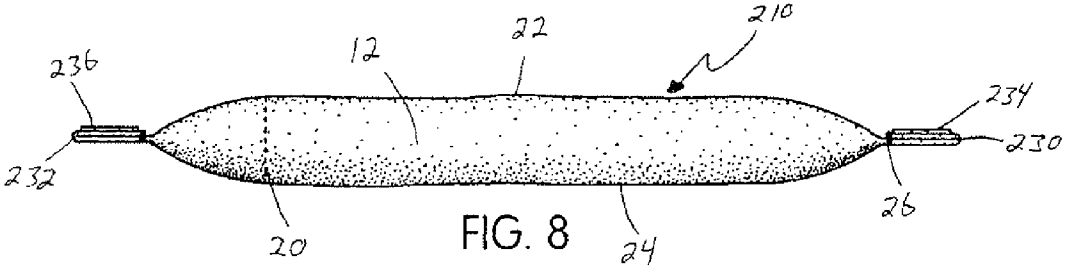
FIG. 8 is a side view of the bag of FIG. 7.

Referring now to FIGS. 7 and 8, a two-handled loose-material bag 210 according to a further embodiment of the invention is shown. Bag 210 generally includes the aspects and preferences of bag 10, except as pertains to the fold-over flaps 230 and 232 discussed hereafter. As shown, bag 210 includes a pair of opposing fold-over flaps 230 and 232 formed as discussed in relation to bag 110. In addition, patches 234 and 236 may optionally be attached to flaps 230 and 232 respectively as discussed in relation to bag 10. As shown in FIG. 7, patches 234 and 236 may be rounded or have other shapes as desired. As with previous embodiments, grips 238 and 240 are formed from a single cut or a series of perforations through the double layers of material in flaps 230 and 232 and, if added, through patches 234 and 236 to form handle 116. Patches 234, 236 complement the folded-over material of flaps 230 and 232 to further reinforce handles 216 and 218. However, the folded-over material of flaps 230 and 232 may have sufficient strength without the addition of patches 234 and 236.

Figure 9:
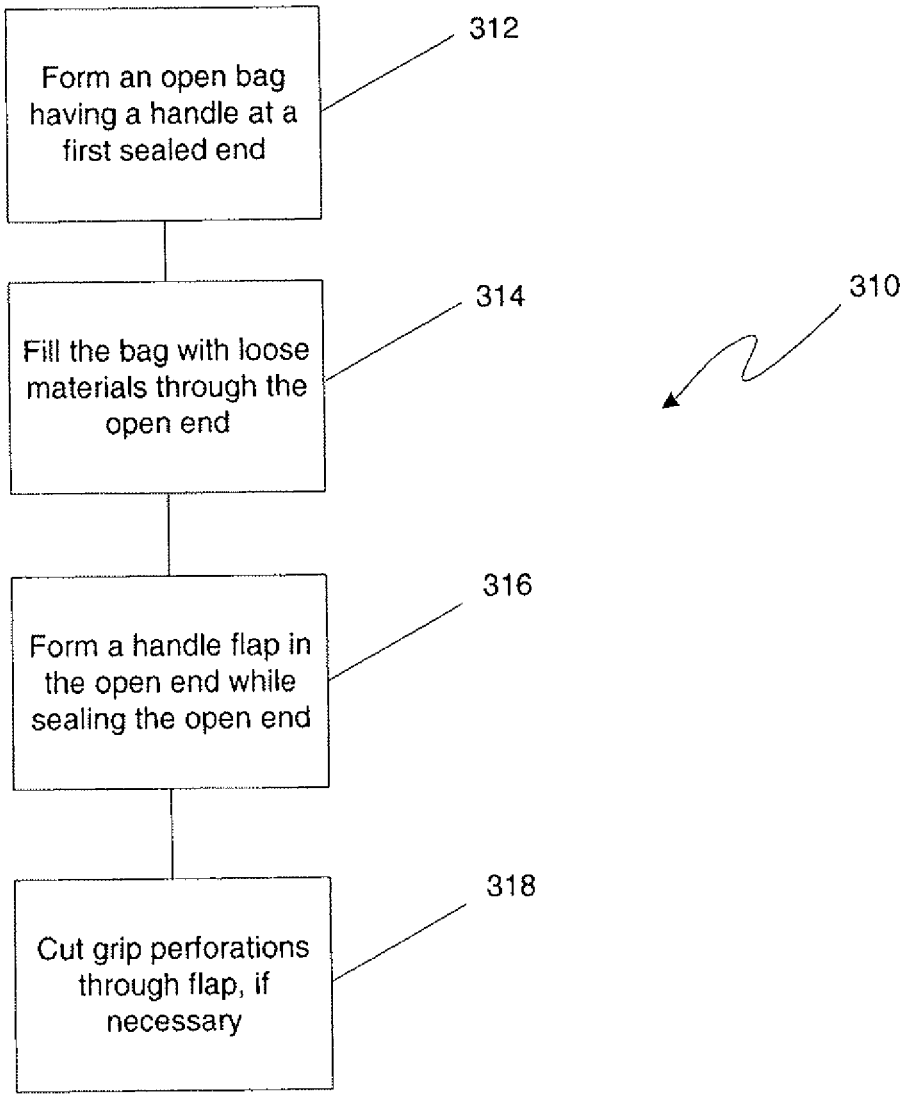
FIG. 9 illustrates a method for filling and sealing a multi-handled bag according to an embodiment of the invention.
Figure 14:
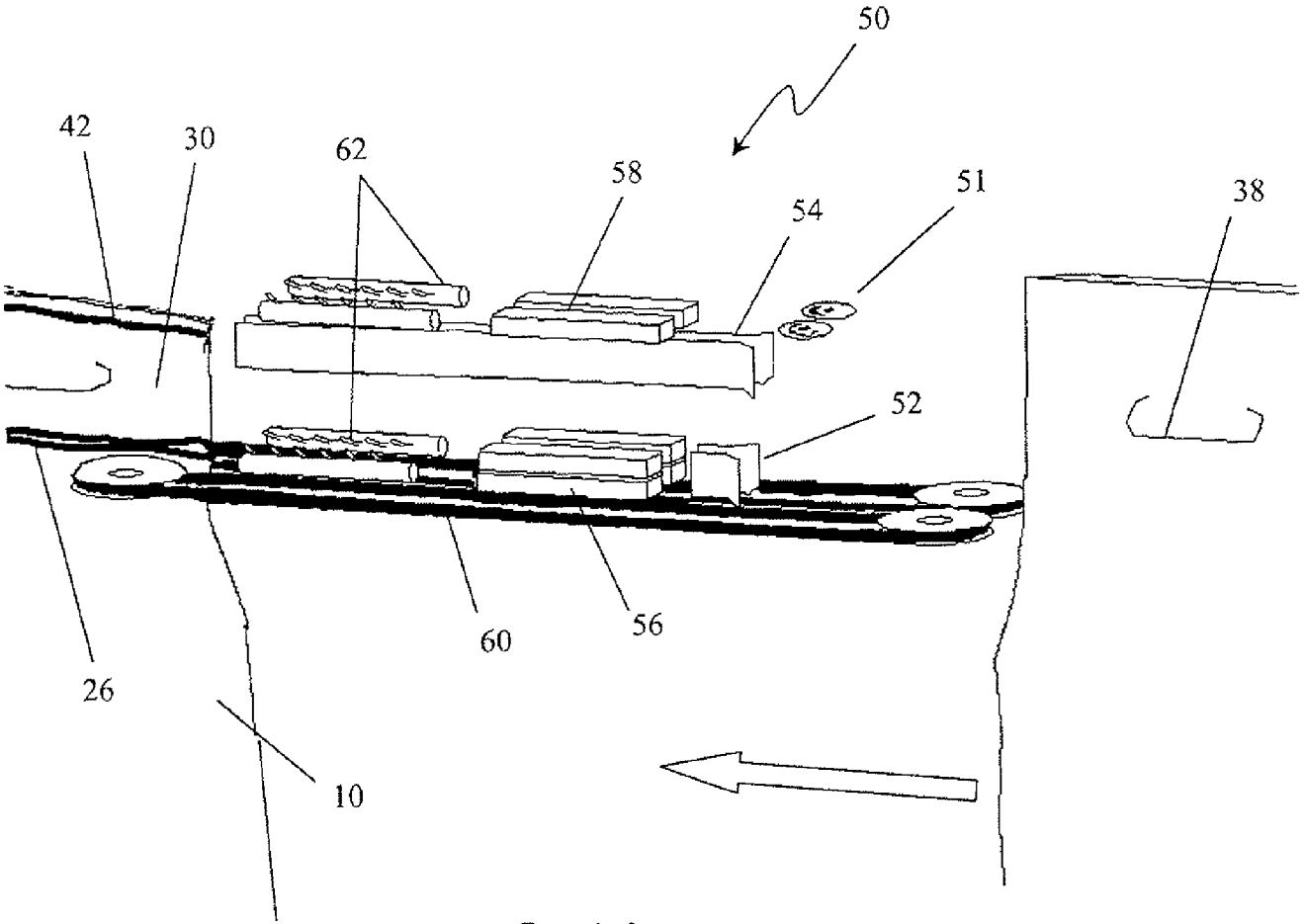
FIG. 14 is a perspective view of a heat-sealing station according to a packaging embodiment of the invention.

Referring now to FIG. 9 along with FIGS. 1 and 14, a method 310 for forming a sealed multi-handle bag, such as bag 10, according to an embodiment of the invention is generally shown. According to method 310, an open bag is formed 312 that has a handle at a first sealed end. Using bag 10 shown in FIG. 1 as an example, an open bag is generally formed from a tube of plastic material, which may include sheets 22 and 24 connected along their lateral sides. The tube of plastic material may be formed from various methods, such as an extrusion process. In an alternative arrangement, an open bag may be formed by sealing sheets 22 and 24 to each other along three sides. A handle 18 may be formed at the first sealed end by sealing opposing sheets 22 and 24 to each other such that an end flap 32 is formed extending beyond seal 28. Preferably, seal 28 is a double seal made up of a pair of substantially parallel seals disposed proximate to each other, which provide a higher strength and a more resilient bond between sheets 22 and 24 than a single seal. A distal seal 44 along the end portions of flap 32 may further connect layers of sheet material forming end flap 32. Distal seal 44 provides a more robust handle 16 by preventing sheet material in flap 32 from being pulled apart.

Handle 18 may be formed by cutting one or more perforations 40 through flap 32 in the shape of a desired grip. Other handle configurations are possible, such as those discussed above along with bags 10, 110 and 210, which may include a reinforcing patch 36 or fold-over layers of material. Reinforcing patches 36, 38 may be added to the appropriate flap regions 30, 32 of sheets 22, 24 at various points in the process. For example, a patch 38 may be added to flap 30 after seal 28 is formed. In another example, patch 38 may be added after the open bag is formed 312, and may be pre-cut with a single cut or perforations to match handle cut(s) 40 in flap 32. In a further example, patch 38 may be pre-applied to bag material prior to forming the open bag, and may be pre-cut via a single cut 40 or with a series of perforations.

In a preferred embodiment, the empty, open bag is filled and sealed via a commercial packaging process 310. In such a commercial process, each open bag is vertically hung on a conveyer (not shown) in an open configuration with the open end oriented upwards and with the first sealed end and handle 18 oriented downwards. The open bag is then filled 314 with loose materials such as salt through the open end. Once filled, a handle flap 30 is formed 316 in the open end while sealing and closing the open end.

FIG. 14 shows a heat-sealing station 50 for bag 10 according to a packaging embodiment of the invention, which illustrates an embodiment for the sealing step 316 of method 310. As shown, opposing sheets 22 and 24 are bonded to each other with a seal 26 such that additional material extends beyond seal 26 to form handle flap 30. Preferably, the layers of material in flap 30 are also sealed to each other along their distal portions to form second distal seal 42. Excess material extending beyond second distal seal 42 may be trimmed via cutters 51 as needed. As shown, seal 26 and distal seal 42 are preferably formed substantially simultaneously.

In the commercial packaging system of which heat-sealing station 50 is a part, this may occur by compressing sheets 22 and 24 between a first pair of opposing guides 52 at the location for seal 26, while substantially simultaneously compressing sheets 22 and 24 between a second pair 54 of opposing guides at the location for distal seal 42. While sheets 22 and 24 are compressed together, a first and second pair of opposing heat-bars 56 transfer heat to sheets 22 and 24 and thereby form seal 26. If a single seal were desired rather than a double seal, only first pair of opposing heat-bars would be used to form seal 26. At substantially the same time, a third pair of opposing heat-bars 58 transfers heat to sheets 22 and 24 to form distal seal 42. A pair of opposing feed belts 60 advances bag 10 between the guides and heat-bars for the sealing operation. An opposing pair of cooling tubes 62 chills seals 26 and 42 as bag 10 advances past cooling tubes 62. As shown, the filled bag is preferably hanging vertically during the sealing process, which keeps the loose materials from interfering with the seals.

Forming seals 26 and 42 at substantially the same time provides several advantages. It reduces the steps in the commercial process compared with separate sealing steps for each seal, which saves production time and costs. Further, compressing sheets 22 and 24 at the same time keeps sheets 22 and 42 in a taut configuration in the area of flap 30, which provides an improved handle 16. In the event of a pre-cut handle, substantially simultaneous sealing the sheets together can provide improved alignment between the pre-cut grip perforations 38 in each sheet.

If handle 16 is not pre-cut, it may be formed by cutting 318 one or more grip perforations 38 through flap 30 into the shape of a desired grip after the heat-sealing operation. As mentioned above, handle 16 may also be formed by pre-cutting one or more perforations 38 through opposing sheets 22 and 24 prior to forming bag 10 or prior to filling and sealing bag 10. When pre-cut, handle 16 is formed from the pre-cut line or series of perforations 38 as opposing sheets 22 and 24 are sealed to each other to form flap 30. Other handle configurations are possible, such as those discussed above along with bags 10, 110 and 210, which may include a reinforcing patch 38 or fold-over layers of material, or such as the rigid handle discussed later along with bag 510.

Figure 10:
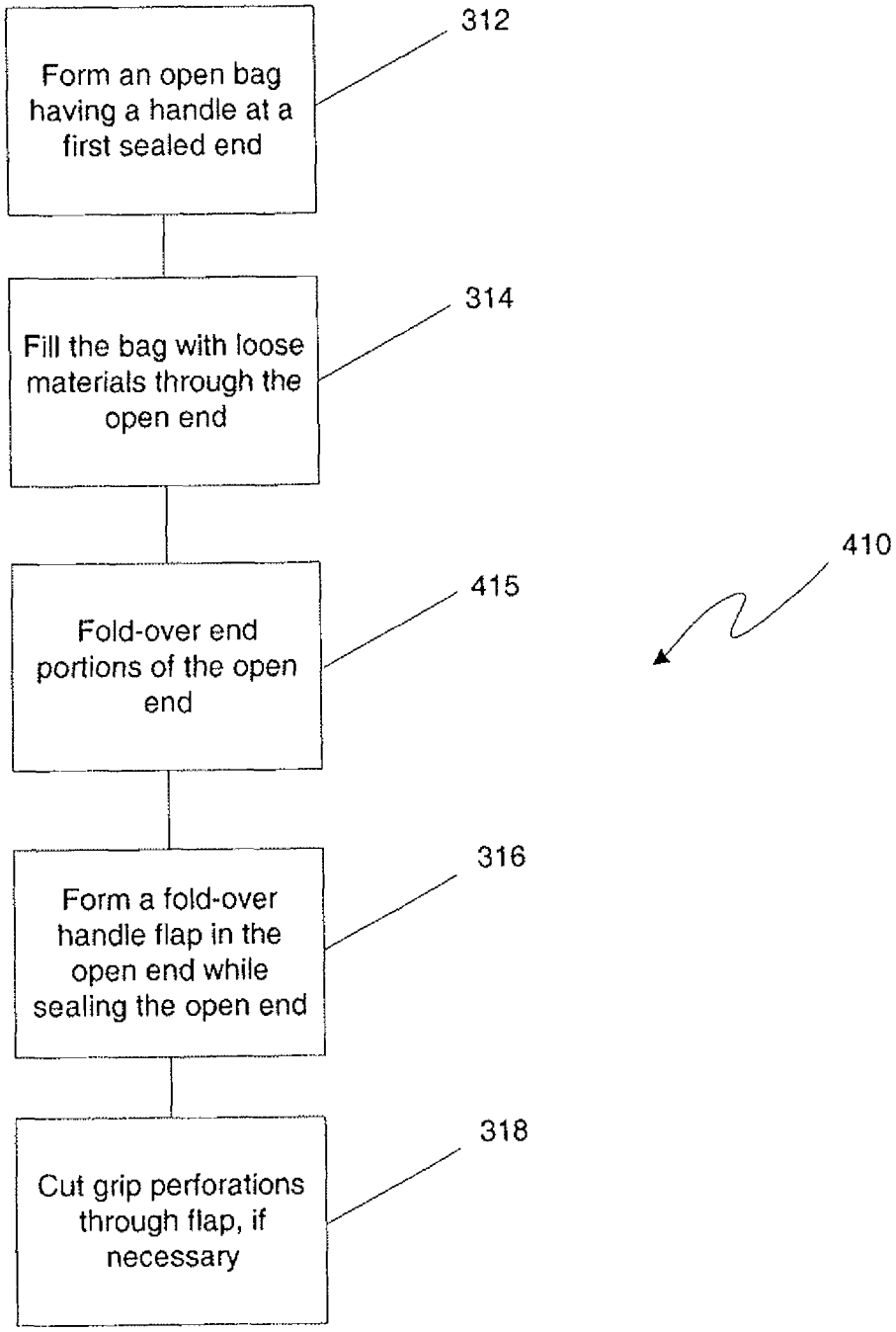
FIG. 10 illustrates a method for filling and sealing a multi-handled bag according to another embodiment of the invention.

Referring now to FIG. 10 along with FIGS. 5 and 6, a method 410 for forming a sealed multi-handled bag, such as bag 110, is generally shown according to another embodiment of the invention. Method 410 includes the same aspects and preferences as method 310, except as relating to the formation of handle 116 along with sealing the open end. As shown, end portions of opposing sheets 22 and 24 may be folded-over 415 to form a fold-over flap 130 as part of sealing the open end. As such, a double-thick handle 116 is formed at the previously open end. As discussed above with method 310, one or more patches may be added to either or both of handle flaps 130 and 32. As also discussed above with method 310, one or more perforations 138 may be cut in flap 130 to form handle 116. Alternatively, one or more perforations 138 may be pre-cut in opposing sheets 22 and 24 prior to forming bag 110 or prior to filling and sealing bag 110. As with method 310, a distal seal (not shown) may also be formed in flap 130.

Figure 11:
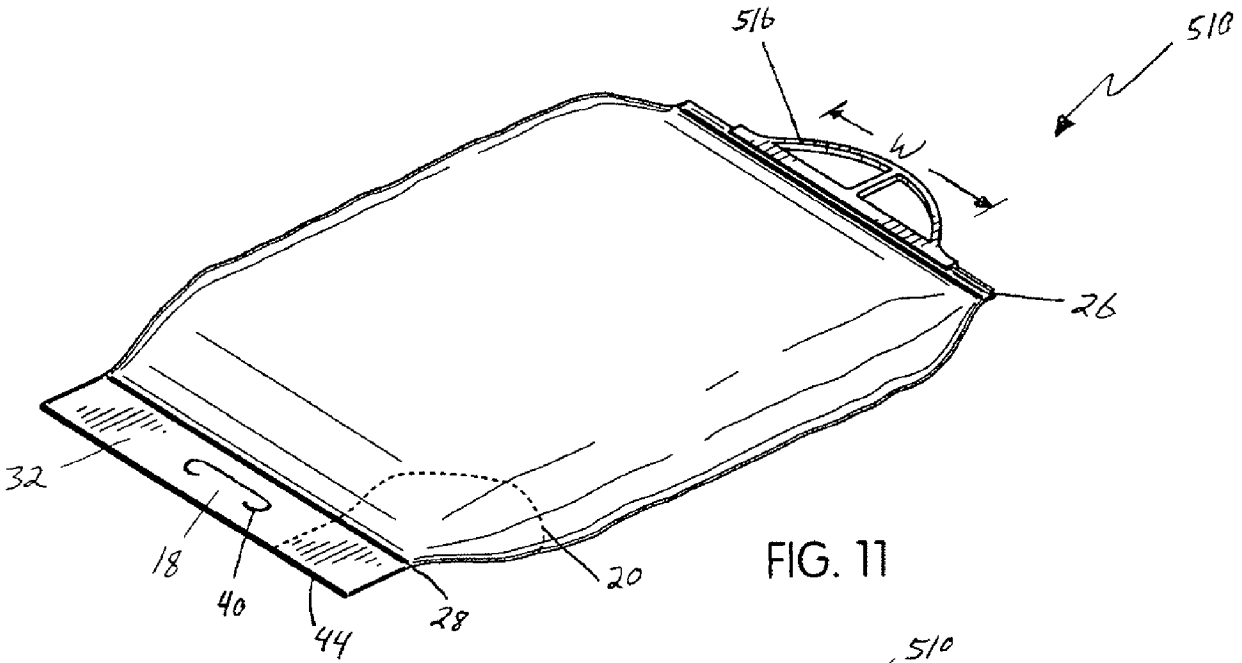
FIG. 11 is a perspective view of a two-handled loose-material bag according to yet another embodiment of the invention.
Figure 12:
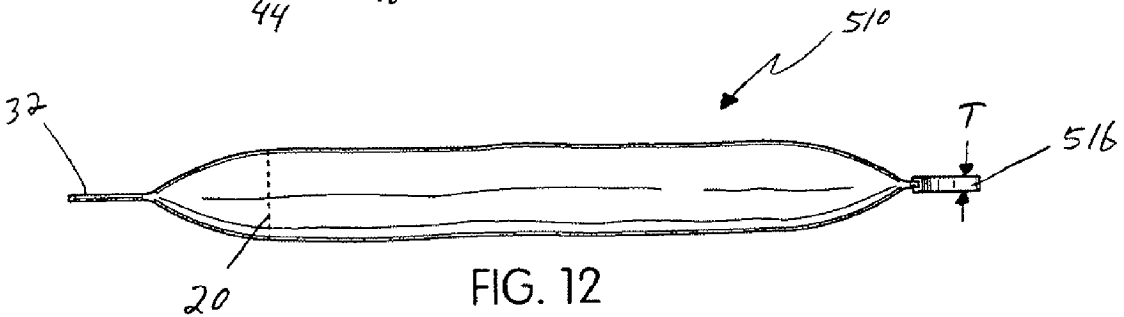
FIG. 12 is a side view of the bag of FIG. 11.

Referring now to FIGS. 11 and 12, a two-handled loose-material bag 510 according to a further embodiment of the invention is shown. Bag 510 generally includes the aspects and preferences of bag 10, except as pertains to the rigid handle 516 discussed hereafter. As shown, bag 510 includes a rigid handle 516 at the first end and a flap 32 at the opposing second end with handle 18 formed therein as discussed in relation to bag 10. As shown, handle 18 includes a single perforation 40 cut to form the grip. As with previously discussed embodiments, the perforation may be cut through the sealed bag, pre-cut in sheet material 22 and 24 prior to forming bag 510, or pre-cut in the unfilled bag.

Rigid handle 516 is a relatively stiff handle made from plastic, metal or a comparatively stiff material, which is attached to bag 510 at the first end. For example, rigid handle 516 may be an injection-molded plastic handle that is bonded to heat seal 26 via a thermal bond, an adhesive bond, or a sewn attachment. Rigid handle 516 provides advantages over handles formed through plastic sheets, such as handle 18 formed in flap 32. For example, rigid handle 516 is comparatively easier to grab than handle 18 due its larger width, W and thickness, T, which is particularly advantageous when used as a single handle to carry bag 510. Consequently, when a user grabs bag 510 using rigid handle 516 as a single handle, the force is spread out over a larger area and thereby transmits less pressure to the user's hand. Further, due to the stiff nature of rigid handle 516, it does not bunch-up around a user's hand, which avoids discomfort associated with pliant handles gathering around a user's hand. In addition, rigid handle 516 may be stronger than handle 18 and comparable handles, which may stretch or break more easily when used as a single handle.

Figure 13:
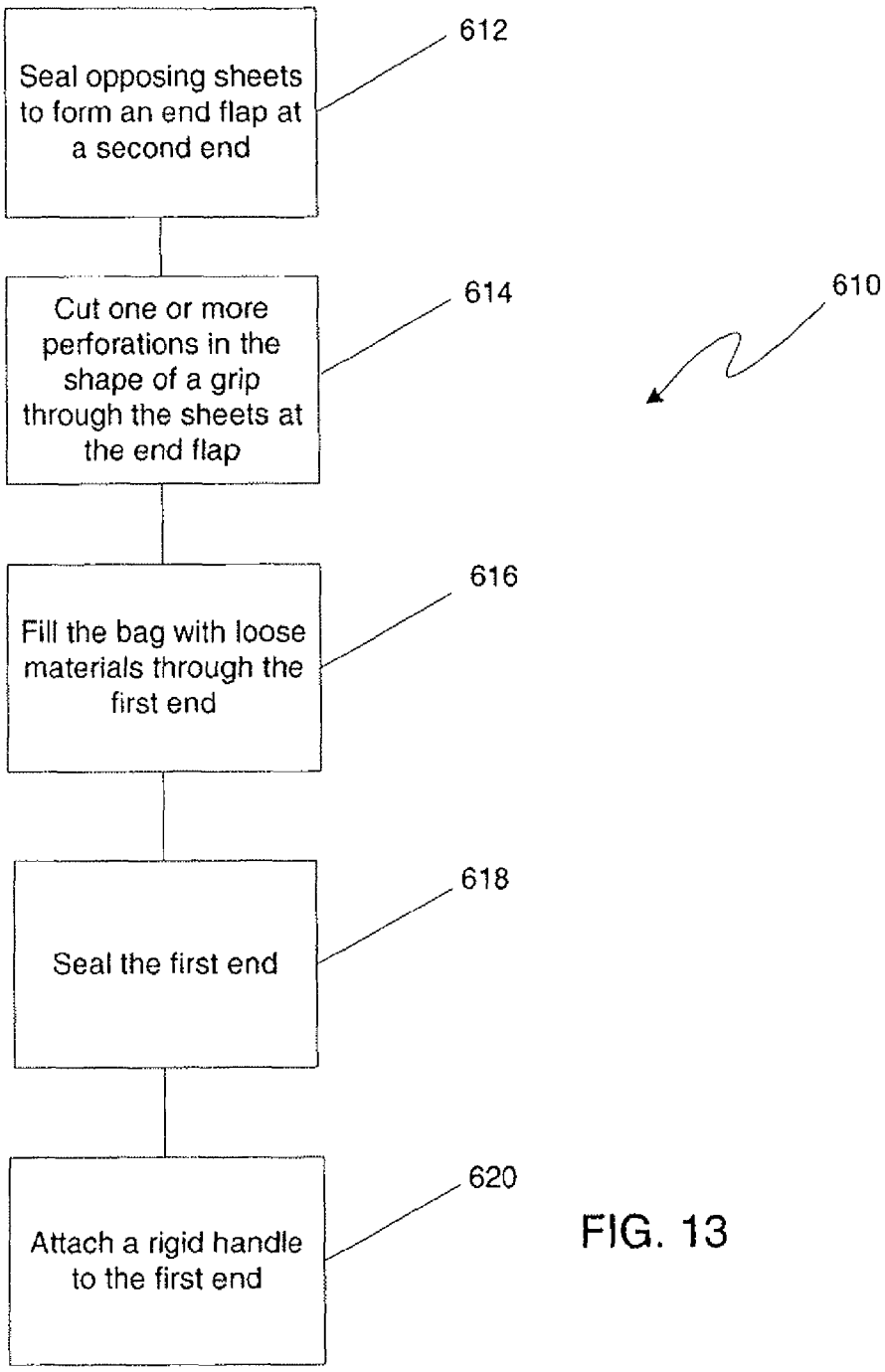
FIG. 13 illustrates a method for filling and sealing a multi-handled bag according to a further embodiment of the invention.

Referring now to FIG. 13 along with FIGS. 10 and 11, a method 610 for forming a sealed multi-handled bag, such as bag 510, is generally shown according to another embodiment of the invention. Method 610 generally includes the same aspects and preferences as method 310, except as relating to the formation of handle 516. As shown, handle 18 is formed at the second end by sealing 612 opposing sheets 22 and 24 to each other such that end flap 32 is formed extending beyond seal 28. A distal seal 44 along the end portions of flap 32 may further connect layers of material forming end flap 32.

Handle 18 may be formed by cutting 614 one or more perforations 40 through flap 32 in the shape of a desired grip. Alternatively, one or more perforations 40 may be pre-cut in opposing sheets 22 and 24, such that handle 18 is formed when sheets 22 and 24 are sealed to each other to form flap 32. Other steps for forming handle 18 may also be used, such as those discussed above along with bags 10, 110 and 210, which may include adding a reinforcing patch or folding-over layers of material. After the open bag is formed, bag 10 is filled 616 with loose materials such as salt through the open first end. Once filled, the first end is sealed 618 to form seal 26. Rigid handle 516 is attached 620 to the first end by attaching it to seal 26 via a heat seal, an adhesive, a mechanical attachment, and/or other attachment means.

While the present invention has been described in connection with the illustrated embodiments, it will be appreciated and understood that modifications may be made without departing from the true spirit and scope of the invention. In particular, the invention applies to light-duty, moderate-duty and heavy-duty bags containing loose materials as well as restrained materials. Further, the invention applies to various shapes and sizes of bags, and to a wide variety of handle types.

We claim:

1. A method for filling and sealing a multi-handled bag having a substantially tubular shaped body without intucked sides, the method comprising:

using a sheet material to form an open bag having a sealed end with a non-resealable bond, an opposite open end, and a handle attached to the sealed end;

filling the bag with loose materials through the open end; and forming a handle flap in the open end while sealing the open end with a non-resealable bond wherein the step of forming a handle flap includes folding-over bag material at the open end to form a double-thick handle flap in the open end.

2. The method of claim 1, further comprising forming one of a cut and a series of perforations through the hand flap to form a grip.

3. The method of claim 1, wherein the step of forming a handle flap includes sealing opposing sheets of bag material together to form a first seal, the first seal defining an inner side of the handle flap proximate to a storage cavity of the bag.

4. The method of claim 3, wherein the step of sealing opposing sheets of bag material together to form a first seal includes sealing the opposing sheets of bag material together at two locations, wherein the first seal includes a double seal.

5. The method of claim 3, wherein the step of forming a handle flap further includes sealing the opposing sheets of bag material together to form a second seal, the second seal defining a distal side of the handle flap.

6. The method of claim 5, wherein the step of sealing the opposing sheets to form the first seal and the step of sealing the opposing sheets to form the second seal occur substantially simultaneously.

* * * * *